United States Patent [19]

Hathaway, II

[11] Patent Number: 4,992,705

[45] Date of Patent: Feb. 12, 1991

[54] FLUORESCENT LIGHTING SYSTEM

[75] Inventor: Alden M. Hathaway, II, St. Louis, Mo.

[73] Assignee: GTE Products Corporation, Danvers, Mass.

[21] Appl. No.: 255,571

[22] Filed: Oct. 11, 1988

[51] Int. Cl.[5] ..... HO5B 41/38

[52] U.S. Cl. ..... 315/324; 315/210; 315/317; 315/318; 315/319; 315/295

[58] Field of Search ..... 315/210, 324, 313, 317, 315/318, 319, 295

[56] References Cited

U.S. PATENT DOCUMENTS

| | | | |
|---|---|---|---|
| 3,778,676 | 12/1973 | Keller | 315/318 X |
| 4,006,384 | 2/1977 | Elms et al. | 315/324 X |
| 4,234,820 | 11/1980 | Widmayer | 315/324 X |
| 4,277,726 | 7/1981 | Burke | 315/98 |
| 4,475,062 | 10/1984 | Radenkovich et al. | 315/324 X |
| 4,488,092 | 12/1984 | Chikuma | 315/324 |
| 4,641,061 | 2/1987 | Munson | 315/210 |

*Primary Examiner*—Eugene R. LaRoche
*Assistant Examiner*—Do Hyun Yoo
*Attorney, Agent, or Firm*—Wolf, Greenfield & Sacks

[57] ABSTRACT

A fluorescent lighting system capable of providing three levels of illumination includes a first circuit in which a line voltage supply is connected to an electronic ballast which drives four fluorescent lamps. Each fluorescent lamp serves as the center lamp in one of four three-lamp parabolic fixtures. A second circuit is comprised of a second line voltage source connected in parallel with two similar electronic ballasts which drive the side fluorescent lamps in the three-lamp parabolic fixtures. When the first circuit is powered, the center lamps in all parabolic fixtures are illuminated to provide a first level of illumination. When the second circuit is powered, the side lamps in all parabolic fixtures are illuminated to provide a second level of illumination. A third level of illumination is provided when both the first and second circuits are powered and all three lamps in all four parabolic fixtures are illuminated.

16 Claims, 3 Drawing Sheets

FLUORESCENT LIGHTING SYSTEM

BACKGROUND OF THE INVENTION

1. Field of the Invention

The present invention relates to the field of electronic illumination systems and more specifically, to fluorescent lighting systems. The present invention provides a high efficiency, fluorescent lighting system which in a preferred embodiment is capable of providing three levels of illumination.

2. Background Discussion

Fluorescent lamps are well known illumination devices throughout the lighting industry. A fluorescent lamp is a particular type of electrical load which possesses an electrical characteristic known as "a negative resistance". That is, a high voltage is required to start the lamp and, once started, a lesser voltage is required to sustain its operation. Two types of fluorescent lamps, the "instant-start" and "rapid-start", are commonly used in existing light fixtures. With the instant-start lamp, a special electron emitting cathode emits electrons under the influence of a high voltage applied across the lamp terminals, without the need for preheating the lamp cathodes. With the rapid-start lamp, heaters or filaments, through which electrical current is passed, heat the cathodes to a sufficiently emissive temperature. In practice, both rapid-start and instant start fluorescent lamps are used with solid-state electronic ballasts which incorporate inverter-oscillator type circuits. These circuits, made of transistors and other semiconductor devices, transform low AC or DC voltages into high voltage required to operate one or more fluorescent lamps Modern AC solid-state ballasts also provide a degree of regulation of lamp current against line variations from the power supply.

Solid-state electronic ballasts are commercially available for one, two, three or four lamp configurations. The four-lamp ballast is generally considered the most energy efficient ballast available. Unfortunately, the three-lamp parabolic fixture is generally considered to be the most energy efficient fluorescent lamp fixture available. Until now, methods of connecting the most energy efficient ballast with the most energy efficient lamp fixture has eluded designers in the lighting industry, with attempts often resulting in design configurations which are costly, complicated and generally less efficient than desired.

Fluorescent lighting systems which provide more than one level of illumination have also proved to be expensive, complicated, and generally less efficient than desired, mostly because a separate ballast/lamp circuit is required for each desired level of illumination.

OBJECTS OF THE INVENTION

Accordingly, it is an object of the present invention to provide a fluorescent lighting system having improved light output efficiency.

Another object of the present invention is to provide an improved fluorescent lighting system comprised of multiple fluorescent lamp fixtures and associated multiple ballasts and in which the number of ballasts are fewer than the number of fixtures.

Still another object of the present invention is to provide an improved fluorescent lighting system that employs a master fixture and associated slave fixtures with the ballasts being provided preferably only in the master fixture.

Another object of the present invention is to provide a fluorescent lighting system which is capable of providing multiple levels of illumination with fewer ballast/lamp circuits than current lighting systems.

A further object of the present invention is to provide a multi-level, fluorescent lighting system which requires considerably less power per lamp to operate than current lighting systems.

Another object of the present invention is to provide an energy efficient, multi-level, fluorescent lighting system which is easily installed and maintained.

SUMMARY OF THE INVENTION

The foregoing and other objects of the present invention are achieved with a lighting system which provides three levels of illumination and uses less watts per square foot than current lighting systems. In accordance with the present invention there is provided a fluorescent lighting system that is comprised of multiple fluorescent lamp fixtures in combination with multiple ballasts for preferably providing, by means of the fluorescent fixtures, multiple levels of illumination. The preferred arrangement is one in which the number of fixtures is greater than the number of ballasts and preferably all ballasts are associated with a master fixture, the other fixtures being slave fixtures.

According to one embodiment of the present invention, four parabolic fixtures, each containing three T-8, 265 milliampere fluorescent lamps, are driven by three four-lamp electronic ballasts. The three electronic ballasts are housed in a master fixture which, through several conduits, drives the other three slave fixtures. A two circuit configuration provides three level lighting. When the first circuit is active, a first ballast drives the center lamps in all four parabolic fixtures to provide the first of three available light levels. When the second circuit is active, the two remaining ballasts drive the side lamps in all four parabolic fixtures to provide a second or intermediate light level. When both the first and second circuits are active, all lamps in all parabolic fixtures are illuminated to provide the third or highest light level.

As an alteration of the first embodiment, one of the three electronic ballasts of the master fixture may be housed in a sub-master fixture which then drives the sideboard lamps in the sub-master fixture and one of the remaining slave fixtures. As with the first embodiment of the present invention, two circuits provide three levels of illumination.

The invention will be more fully understood from the detailed description set forth below, which should be read in conjunction with the accompanying drawings. The invention is description, which is offered by way of example.

DETAILED DESCRIPTION

Figure 1:
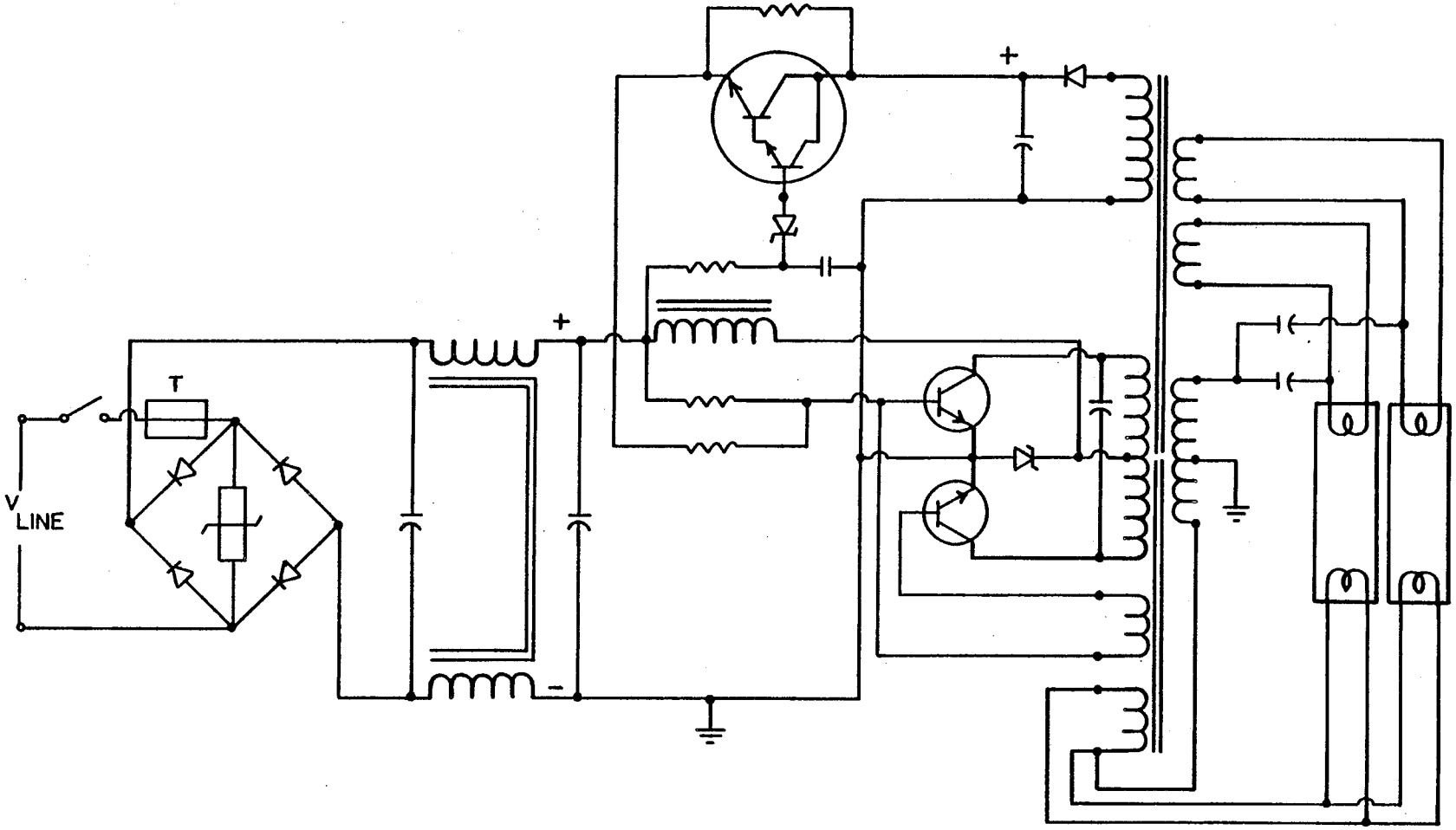
FIG. 1 is an electrical schematic of an electronic ballast of the type used in the present invention.

FIG. 1 shows an illustrated embodiment of a transistorized fluorescent lamp ballast and lamp combination of the type described in detail in U.S. Pat. No. 4,277,726, issued to Burke, on July 7, 1981, entitled A SOLID-STATE BALLAST FOR RAPID-START TYPE FLUORESCENT LAMPS. The operation and construction of the solid-state ballast is discussed in detail in the Burke patent, which is hereby incorporated by referrence and will not be repeated herein for clarity.

Although the solid-state ballast in the Burke patent is designed for use with two rapid-start fluorescent lamps, the adaptation of such a design to accommodate three or four fluorescent lamps is within the grasp of those reasonably skilled in the art and will not be described herein.

The present invention utilizes a transistorized fluorescent lamp ballast of a design similar to the Burke patent but which can accommodate four instant start fluorescent lamps. Such an electronic ballast suitable for use in the present invention is commercially available from Triad-Utrad, Huntington, Ind. 46750; Model Ballastar B432I120 or Ballastar B432I277 depending on a line voltage of either 120 or 277 volts respectively.

In the preferred embodiment, the fluorescent lamps of the present invention have a 256 milliampere and 32 watt rating. A fluorescent lamp suitable for use in the present invention is the Sylvania F032 Octron available from GTE Products Inc Sylvania Lighting Center, Danvers, Mass. 01923.

Figure 2:
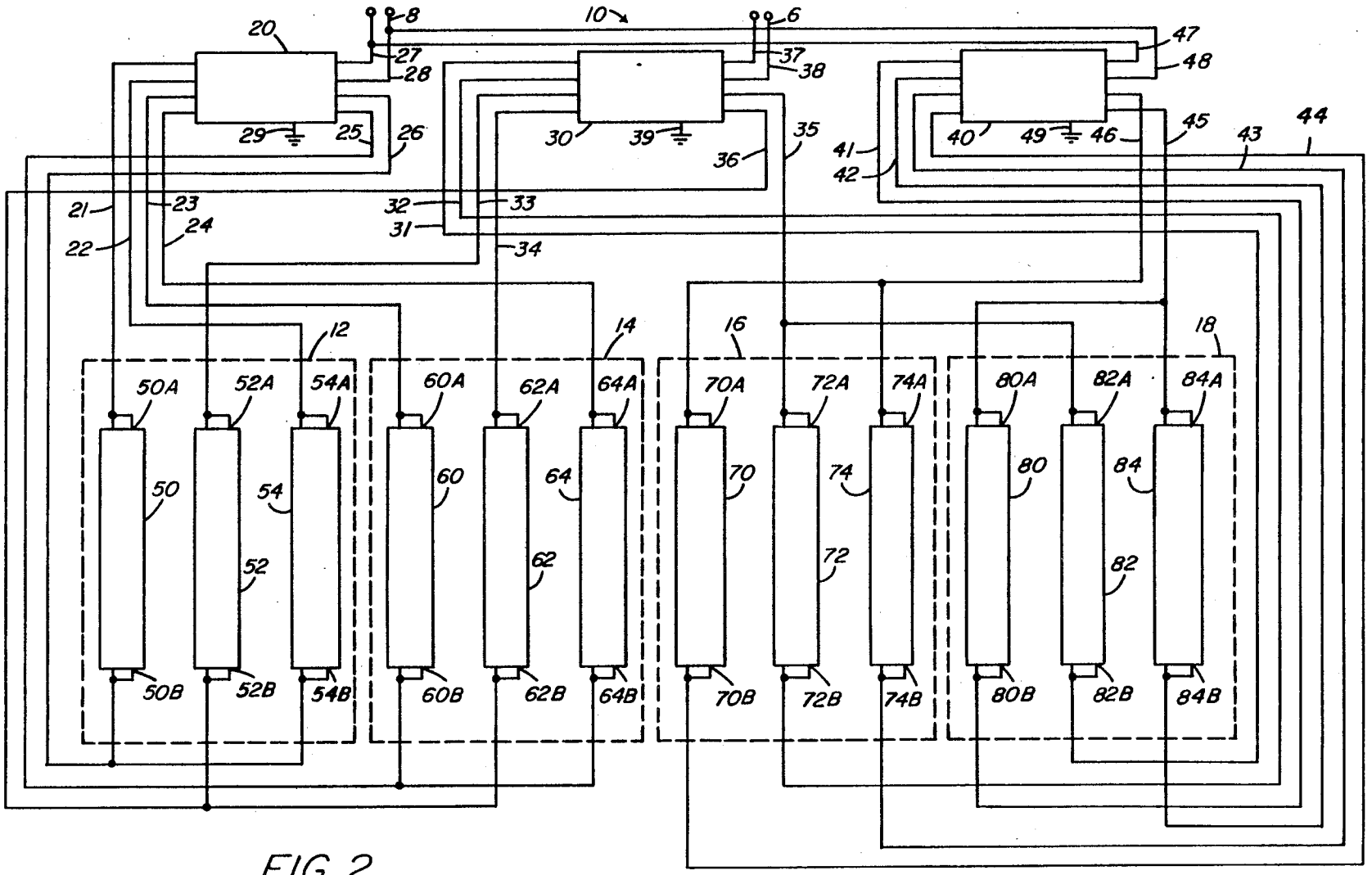
FIG. 2 is an electrical block diagram of the present invention illustrating the electrical connections between system components.

FIG. 2 is a block electrical schematic of a three-level lighting system 10 which is comprised of a first ballast-/lamp circuit 6 and a second double ballast/lamp circuit 8.

Circuit 6 drives the center lamp in each of the three-lamp parabolic fixtures 12, 14, 16, 18, thereby providing the first and lowest level of illumination. Circuit 6 is comprised of electronic ballast 30 and fluorescent lamps 52, 62, 72 and 82. Ballast 30 operates at an input frequency of 60 Hz, rated for a line voltage of either 120 V or 277 V, and operates fluorescent lamps 52, 62, 72 and 82 at a frequency of between 20 to 30 KHz. Lead wires 37 and 38 connect ballast 30 to a conventional line voltage source. Lead wire 39 of ballast 30 connects the ballast to a conventional electric ground for providing an arbitrary zero volts reference.

The lead wires of ballast 30 are connected to the cathodes of lamps 52, 62, 72 and 82. Lead wire 31 is connected to cathode 82B of lamp 82 while lead wire 32 is connected to cathode 72B of lamp 72. In a similar manner, lead wire 33 is connected to cathode 52A of lamp 52 while lead wire 34 is connected to cathode 62A of lamp 62. Lead wire 35 of ballast 30 is connected in parallel to cathodes 72A and 82A of lamps 72 and 82 respectively. Likewise, a lead wire 36 of ballast 30 is connected in parallel to cathodes 52B and 62B of lamps 52 and 62, respectively.

A second level of illumination is provided by circuit 8 of lighting system 10. Circuit 8 is comprised of electronic ballasts 20 and 40 and the side lamps in parabolic fixtures 12, 14, 16, 18. A conventional lie voltage source, similar to that which supplies power to ballast 30, is connected in parallel to ballasts 20 and 40 via lead wires 27, 28 and 47, 48, respectively. Lead wires 29 and 49 of ballasts 20 and 40, respectively, provide a conventional ground connection, similar to that provided by lead 39 of ballast 30. Lead wires 21–26 of ballast 20 drive the side lamps in parabollic fixtures 12 and 14. In a similar manner, lead wires 41–46 drive the side lamps of fixtures 16 and 18. Lead wire 21 of ballast 20 is connected to cathode 50A of lamp 50 while lead wire 22 is connected to cathode 54A of lamp 54. In a similar manner, lead wire 23 is connected to cathode 60A of lamp 60 while lead wire 24 is connected to cathode 64A of lamp 64. Lead wire 26 is connected in parallel to cathodes 50B and 54B of lamps 50 and 54 respectively. Likewise, lead wire 25 is connected to cathodes 60B and 64B of lamps 60 and 64 respectively.

Ballast 40 is similarly configured to drive the side lamp in fixtures 16 and 18. Lead wire 41 of ballast 40 is connected to cathode 80B of lamp 80 while lead wire 42 is connected to cathode 84B of lamp 84. In a similar manner, lead wire 43 also of ballast 40 is connected to cathode 74B of lamp 74 while lead wire 44 is connected to cathode 70B of lamp 70. Lead wire 46 of ballast 40 is connected in parallel to cathodes 70A and 74A of lamps 70 and 74, respectively. Likewise, lead wire 45 of ballast 40 is connected in parallel to cathodes 80A and 84A of lamps 80 and 84, respectively.

Lighting system 10 provides three levels of illumination by driving circuits 6 and 8 either singularly or in combination. When circuit 6 is driven alone a first and lowest level of illumination is provided in which only the center lamp of each of fixtures 12, 14, 16, 18 is illuminated. When circuit 8 is active, the two side lamps in each of fixtures 12, 14, 16, 18 are illuminated to provide an intermediate level of illumination. When circuits 6 and 8 of lighting system 10 are active a third and highest level of illumination is provided in which all three lamps in each of fixtures 12, 14, 16, 18 are illuminated.

Having described circuit 6 and circuit 8 which comprise the three level lighting system 10, the actual physical arrangement of ballast 20, 30 and 40 in relation to fluorescent lamps 50, 52, 54; 60, 62, 64; 70, 72, 74; 80, 82, 84; and parabolic fixtures 12, 14, 16, 18 is outlined below.

Figure 3:
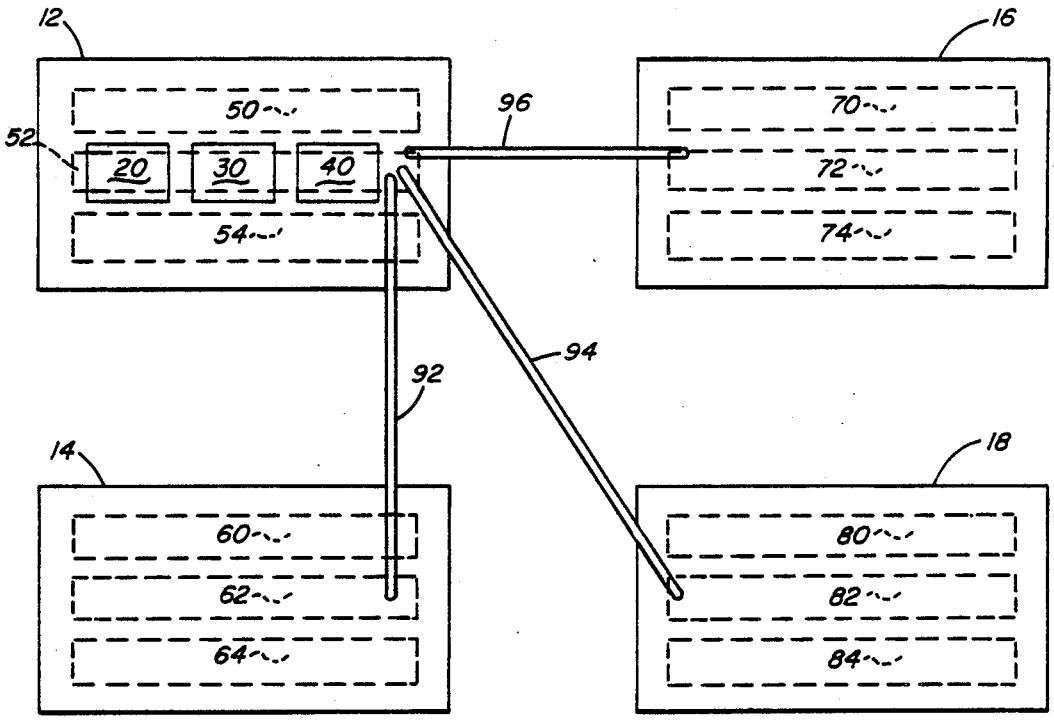
FIG. 3 is a block diagram of the present invention illustrating a master/slave configuration.
Figure 4:
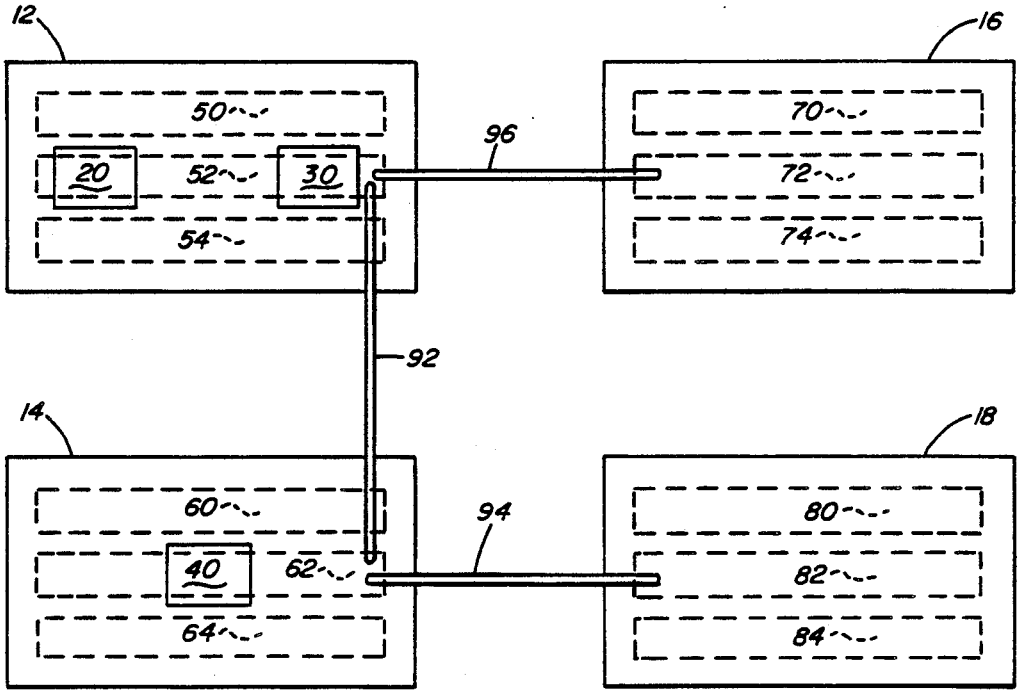
FIG. 4 is a block diagram of the present invention illustrating a master/sub-master configuration.

FIGS. 3 and 4 are block diagrams showing the actual physical positioning of the elements comprising system 10 for two different embodiments in accordance with the invention. In both physical configurations, circuits 6 and 8 are electrically configured according to FIG. 2, as described above In a first or master/slave configuration, shown in FIG. 3, parabolic fixture 12 incorporates electronic ballasts 20, 30 and 40, thereby serving as a master fixture. Fixtures 14, 16, and 18 serve as slave fixtures which are driven by ballasts 20, 30 and 40 in master fixture 12. Most of the lead wires connecting ballasts 20, 30 and 40 to the cathodes of fluorescent lamps lamps 50–54, 60–64, 70–74, and 80–84 are collectively connected to fixtures 14, 16 and 18 through conduits 92, 96 and 94, respectively.

A three lamp parabolic fixture suitable for use in the present invention is available from Lithonia Fluorescent Conyers, Ga. 30207; model Paramax 2PM3 340.

In the preferred embodiment of the present invention, conduits 92, 94, 96 are of a special modular design which can accommodate up to three circuits within the conduit structure and which contains pin and socket terminating contacts. Such a conduit design allows for easier installation and rewiring than conventional conduit structures. Such a modularized conduit is also commercially available from Lithonia Fluorescent, model System 820 Relock Wiring System.

FIG. 4 illustrates a second or master/sub-master configuration for the elements of system 10. As with the first master/slave configuration illustrated in FIG. 3, the components comprising system 10 are connected electrically according to FIG. 2. In the master/sub-master configuration, electronic ballasts 20 and 30 are integrated within master fixture 12. The third electronic ballast, ballast 40, is incorporated into a sub-master fixture 14. In this master/sub-master configuration the line voltage supply for circuit 6 is connected directly to ballast 30 on master fixture 12. The line voltage supply for circuit 8 is connected in parallel to ballasts 20 and 40 on master fixture 12 on sub-master fixture 14, respectively. As with the master/slave configuration, most of the lead wires extending from ballasts 20, 30 and 40 are connected to the cathodes of fluorescent lamps 50-84 via conduits 92, 94 and 96. Conduit 92 connects master fixture 12 with sub master fixture 14. Conduit 94 connects sub-master fixture 14 with slave fixture 18. Similarly, conduit 96 connects master fixture 12 to slave fixture 16. In the master/sub master configuration the preferred fixture and conduit models are similar to those of the master/slave configuration.

A three-level lighting system electrically constructed as illustrated in FIG. 2 and physically arranged according to either the master/slave or the master/sub-master configurations shown in FIGS. 3 and 4, respectively, has several distinct advantages over prior art fluorescent lighting systems. For example, lighting systems which utilize multiple circuits for multiple levels of illumination usually require a separate circuit for each level of illumination. For example, a three-level lighting system would require three separate circuits, a four-level lighting system would require four separate circuits, etc. The present invention provides a three-level lighting system in which three distinct levels of illumination are produced by a system which contains only two circuits, thereby saving energy and reducing installation and maintenance cost.

Another advantage of the present invention is the reduction in system components. Electronic ballasts which are capable of driving three or four fluorescent lamps are well known in the lighting industry, as are three-lamp parabolic fixtures. However, in current lighting installations it is typical to have a single three lamp electronic ballast incorporated into each three lamp parabolic fixture. Such a practice requires four electronic ballasts to power twelve fluorescent lamps. Similar ballast/lamp wiring configurations have failed to yield any combination in which the savings of components outweighs the increased wiring complexity and installation costs. By using the preferred three, four-lamp ballasts to drive four, three-lamp parabolic fixtures, the present invention reduces by 25% the number of electronic ballasts required for a twelve-lamp lighting system. Such a reduction reduces not only the actual cost of system components but installation and maintenance costs as well.

Still another advantage of the present invention is increased energy savings. Fluorescent lighting system 10 has the lowest watts per square foot energy usage of any fluorescent lighting system commercially available. Each electronic ballast of the present invention draws 106 watts resulting in an average operating power of 79.5 watts per fixture. The three-lamp electronic ballasts normally used with a three-lamp parabolic fixture draw 84 watts per fixture. Thus, the present invention yields a saving of 4.5 watts per fixture over a design in which four, three lamp electronic ballasts are used to power four, three-lamp parabolic fixtures. In building installations which typically require hundreds of fixtures, the energy savings from the present invention are significant. The present invention will also enable additional savings due to load reductions on heating, ventilation and air conditioning equipment.

As outlined above, the present invention reduces the number of electronic ballasts necessary for a twelve lamp lighting system, provides three levels of illumination from only two circuits, and uses less watts per square foot than any system commercially available. Furthermore, the modular conduit design enables reduced installation, rewiring and maintenance costs.

Having thus described the invention, various alterations, modifications and improvements will readily occur to those skilled in the art. Such alterations, modifications and improvements made obvious by this disclosure are intended to be part of this disclosure though not expressly stated herein, and are intended to be in the spirit and scope of the invention. Accordingly, the foregoing description is intended to be exemplary only and not limiting. The invention is limited only as defined in the following claims and equivalents thereto.

What is claimed:

1. A fluorescent lighting system comprising a plurality of ballast circuits, a plurality of fluorescent lighting fixtures each including a set of fluorescent lamps, circuit means for coupling each of the ballast circuits with at least one fluorescent lamp in different ones of said lighting fixtures to provide illumination of said fluorescent lamps.

2. The fluorescent lighting system of claim 1 wherein said circuit means includes means for selectively operating said fluorescent lamps at one of multiple different light levels and wherein the number of said ballast circuits is fewer than the number of said fluorescent lighting fixtures.

3. The fluorescent lighting system of claim 2 wherein said circuit means includes a first circuit means for providing a first level of illumination, a second circuit means for providing a second level of illumination and means for operating said first and second circuit means for providing a third level of illumination.

4. The fluorescent lighting system of claim 3 wherein said plurality of fluorescent lighting fixtures comprise four fixtures and each set of fluorescent lamps comprises three lamps.

5. The fluorescent lighting system of claim 1 wherein at least some of said plurality of ballast circuits are contained in a single fluorescent lighting fixture defining a master fixture.

6. The fluorescent lighting system of claim 5 wherein all said ballast circuits are contained in the master fixture.

7. The fluorescent system of claim 5 wherein some of the plurality of ballast circuits are contained in a first fixture and at least one other ballast circuit is contained in a second fixture.

8. The fluorescent lighting system of claim 1 wherein the number of ballast circuits is equal to the number of fluorescent lamps per set.

9. A fluorescent lighting system capable of providing three levels of illumination comprising:

a plurality of at least four fluorescent lighting fixtures each including three fluorescent lamp means;

a first circuit means for illuminating one of said fluorescent lamp means in each of said fixtures for providing a first level of illumination, said first circuit means comprising, four fluorescent lamp means each having a negative resistance characteristic and being of the type requiring a high starting voltage and a lower operating voltage, each of said lamp means containing two cathodes, a first electronic ballast means for providing starting and operating voltages to each of said four fluorescent lamp means, a first lead means extending from said first electronic ballast means for connecting said first electronic ballast means to the cathodes of said four fluorescent lamp means and to a first circuit voltage source;

a second circuit means for illuminating of the remaining of said fluorescent lamp means in each of said fixtures for providing a second level of illumination, said second circuit means comprising, eight fluorescent lamp means each having a negative resistance characteristic and being of the type requiring a high starting voltage and a lower operating voltage, each of said lamp means containing two cathodes, second and third electronic ballast means, each capable of providing starting and operating voltages for four of said eight fluorescent lamp means, a second lead means for connecting each of said second and third electronic ballast means to the cathodes of four of said eight fluorescent lamp means and to a second circuit voltage source;

said first and second circuit means including means for illuminating all of said fluorescent lamp means in each of said fixtures for providing a third level of illumination; and wherein said first, second and third electronic ballast means are incorporated into one of said fixtures, said one fixture thereby serving as a master fixture, and said first and second lead means are connected to the remaining of said fixtures from the master fixture by a plurality of conduit means.

10. A fluorescent lighting system capable of providing three levels of illumination comprising:

a plurality of at least four fluorescent lighting fixtures each including three fluorescent lamp means;

a first circuit means for illuminating one of such fluorescent lamp means in each of said fixtures for providing a first level of illumination, said first circuit means comprising:

four fluorescent lamp means each having a negative resistance characteristic and being of the type requiring a high starting voltage and a lower operating voltage, each of said lamp means containing two cathodes, a first electronic ballast means for providing starting and operating voltages to each of said four fluorescent lamp means, a first lead means extending from said first electronic ballast means for connecting said first electronic ballast means to the cathodes of said four fluorescent lamp means and to a first circuit voltage source;

a second means for illuminating of the remaining of said fluorescent lamp means in each of said fixtures for providing a second level of illumination, said second circuit means comprising, eight fluorescent lamp means each having a negative resistance characteristic and being of the type requiring a high starting voltage and a lower operating voltage, each of said lamp means containing two cathodes, second and third electronic ballast means, each capable of providing starting and operating voltages for four of said eight fluorescent lamp means;

a second lead means for connecting each of said second and third electronic ballast means to the cathodes of four of said eight fluorescent lamp means and to a second circuit voltage source;

said first and second circuit means including means for illuminating all of said fluorescent lamp means in each of said fixtures for providing a third level of illumination; and wherein said first and second electronic ballasts means are incorporated into one of said fixtures, said one fixture serving as a master fixture, said third electronic ballast means is incorporated into a second of said fixtures, said second fixture serving as a sub-master fixture, said first lead means is connected from said master fixture to said sub-master fixture and the remaining of said fixtures by a plurality of conduit means, said second lead means is connected from said sub-master fixture to said master fixture and the remaining of said fixtures by said plurality of conduit means.

11. The fluorescent lighting system of claim 9 wherein said fluorescent lamp means are of the instant-start type, requiring no heating of said lamp cathodes.

12. The fluorescent lighting system of claim 10 wherein said fluorescent lamp means are of the instant-start type, requiring no heating of said lamp cathodes.

13. The fluorescent lighting system of claim 9 wherein said conduit means comprises a modular relock wiring apparatus which is capable of carrying at least three different electrical circuits and which is terminated at each end by pin and socket contacts for attachment to said fixtures.

14. The fluorescent lighting system of claim 10 wherein said conduit means comprises a modular relock wiring apparatus which is capable of carrying at least three different electrical circuits and which is terminated at each end by pin and socket contacts for attachment to said fixtures.

15. A circuit comprised of a plurality of electronic ballast means of the instant start type for providing starting and operating voltages to fluorescent lamps, a plurality of fluorescent lamps, a plurality of fixtures for housing said fluorescent lamps, and lead means for connecting said ballast means to the cathodes of said fluorescent lamps and to a line voltage supply, each of said electronic ballast means capable of providing starting and operating voltages to four said fluorescent lamps, each of said four-lamp electronic ballasts being electrically coupled to the cathodes of four of said fluorescent lamps, one of said electronic ballasts being electrically coupled to a voltage supply and said other electronic ballasts are connected in parallel to a different voltage supply wherein the number of said electronic ballast means is less than the number of said fixtures.

16. A fluorescent lighting system comprising:

twelve fluorescent lamp means, each having a negative resistance characteristic being of the type requiring a high starting voltage and a lower operating voltage, each of said lamp means containing two cathodes;

a first voltage supply;

a second voltage supply;

three electronic ballast means, each capable of providing starting and operating voltages to four of said twelve fluorescent lamp means;

lead means extending from each of said electronic ballast means for connecting each of said electronic ballast means to either said first or second voltage supply and to the cathodes of four of said fluorescent lamp means;

said fluorescent lamp means are incorporated into four three-lamp fixtures, each of said fixtures being capable of accommodating three fluorescent lamps, a first of said electronic ballasts is electrically coupled by said lead means to said first voltage supply and to the cathodes of one of said fluorescent lamps of each of said fixtures, a second and third of said electronic ballast means are electrically coupled by said lead means to said second voltage supply and to said remaining fluorescent lamps in said fixtures.

* * * * *